US007337925B2

(12) United States Patent
Imaizumi et al.

(10) Patent No.: US 7,337,925 B2
(45) Date of Patent: Mar. 4, 2008

(54) MULTI-CHAMBER CONTAINER ELEMENT BODY

(75) Inventors: Yasuyuki Imaizumi, Koto-ku (JP); Shigeo Iizuka, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 115 days.

(21) Appl. No.: 10/507,499

(22) PCT Filed: May 30, 2003

(86) PCT No.: PCT/JP03/06824

§ 371 (c)(1),
(2), (4) Date: Nov. 5, 2004

(87) PCT Pub. No.: WO03/101851

PCT Pub. Date: Dec. 11, 2003

(65) Prior Publication Data

US 2005/0126936 A1 Jun. 16, 2005

(30) Foreign Application Priority Data

May 31, 2002 (JP) ..... 2002-160208
May 31, 2002 (JP) ..... 2002-160209

(51) Int. Cl.
*B65D 35/22* (2006.01)

(52) U.S. Cl. ..... 222/145.3; 215/6; 220/530; 222/94

(58) Field of Classification Search ..... 222/94–95, 222/105, 107; 220/530; 383/38
See application file for complete search history.

(56) References Cited

U.S. PATENT DOCUMENTS 3,224,640 A * 12/1965 Schneider et al. ..... 222/94

(Continued)

FOREIGN PATENT DOCUMENTS

JP A-59-115262 7/1984

(Continued)

*Primary Examiner*—Bryon P. Gehman
(74) *Attorney, Agent, or Firm*—Oliff & Berridge, PLC

(57) ABSTRACT

The object of this invention is to provide a multi-partitioned body of a tubular container, in which inner space is divided by a partition wall or walls into multiple compartments disposed in a row. Technically, such a multi-partitioned body of a tubular container can be manufactured in a single molding operation, at a low cost, and in as few production steps as possible, causing no seam that spoils the appearance of the multi-partitioned tubular body and allowing the lower end of the body of a tubular container to be pressed flat in a uniform thickness. The tubular body comprises the inner layer 2 and the outer layer 3 unpeelably laminated with each other over some peripheral length or lengths in a certain range or ranges of the ring cross-section. The inner layer 2 can be broken away from the outer layer 3 to form a partition wall or walls 8 that divide the inner space 9 of the tubular body into compartments.

9 Claims, 7 Drawing Sheets

U.S. PATENT DOCUMENTS

| | | | | | |
|---|---|---|---|---|---|
| 3,378,169 | A | * | 4/1968 | Clark | 222/95 |
| 3,936,334 | A | * | 2/1976 | Kushida et al. | 222/94 |
| 5,076,464 | A | * | 12/1991 | Simon | 220/530 |
| 5,373,966 | A | * | 12/1994 | O'Reilly et al. | 222/94 |
| 5,615,803 | A | * | 4/1997 | Hatakeyama et al. | 222/94 |
| 5,849,241 | A | * | 12/1998 | Connan | 215/6 |
| 5,860,565 | A | * | 1/1999 | Winston et al. | 222/94 |
| 5,941,420 | A | * | 8/1999 | Connan | 222/94 |
| 5,954,234 | A | * | 9/1999 | Connan et al. | 222/94 |
| 6,332,726 | B2 | * | 12/2001 | Yamamoto et al. | 401/183 |
| 6,742,676 | B2 | * | 6/2004 | Nakamura et al. | 222/95 |
| 6,959,840 | B2 | * | 11/2005 | Iwatsubo | 222/94 |
| 7,044,334 | B2 | * | 5/2006 | Mita et al. | 222/94 |

FOREIGN PATENT DOCUMENTS

| | | |
|---|---|---|
| JP | U-63-131944 | 8/1988 |
| JP | A-04-158017 | 6/1992 |
| JP | A-05-077345 | 3/1993 |
| JP | A-2000-016459 | 1/2000 |
| JP | A-2001-507640 | 6/2001 |

* cited by examiner (A)

(B)

MULTI-CHAMBER CONTAINER ELEMENT BODY

TECHNICAL FIELD

This invention relates to multi-partitioned tubes, which are tubular bodies having multiple compartments that are longer than are wide, disposed in a line, and filled separately with different contents to be used together, as by mixing components of the contents.

BACKGROUND OF THE INVENTION

Multi-partitioned tubes are known as the containers for cosmetics or adhesives. These containers have multiple compartments to be separately filled with various contents that differ in color and property but are used together, as by mixing the components.

In the case of tubular containers, the tube has the ring cross-sectional area partitioned into a couple of compartments and is hereinafter referred to as a multi-partitioned body of a tubular container or a multi-partitioned tube. The tube is cut to a certain length, and each section of tube is provided with a head portion comprising neck for discharging the contents at the upper end. Each tubular body is sealed at the other end as by pressing flat and welding the lower end.

The following processes have been proposed in the conventional art to manufacture the multi-partitioned tubular body that is a main member of the multi-partitioned tubular container:

(1) A process for combining and fixing a set of molded components, as by adhesion; and (2) A process for fitting partition walls inside the molded tube to divide the inner space into multiple compartments, as by using the welding means.

However, the above-described first process of conventional art had the following problems:

(1) This process requires a step of joining the components together as by using adhesion.

(2) The seams of joined components are visible from outside. Since these seams give a bad effect on the appearance of the tube, a sheet of decorative material may be used to conceal the seams. In that case, a new material and an additional process step are required, thus causing an increased cost.

The second process of conventional art had the following problems:

(1) This process requires the steps of molding partition walls and fitting a wall or two to the inner surface of the tube, thus causing an increased cost.

(2) The lower end of the tube is pressed flat for sealing. Since at that time, the lower end thickness becomes non-uniform due to the effect of the partition walls, the seal welding is troublesome.

This invention has been made to solve the above-described problems. A technical problem of this invention is to obtain a multi-partitioned body of a tubular container in a single operation, in which inner space is divided into multiple compartments by a partition wall or walls. Another problem is to avoid seams that spoil the appearance of the multi-partitioned tubular body. Still another problem is to allow the lower end of the tube to be pressed flat in a uniform thickness. The object of this invention is to provide a multi-partitioned tubular container that can be manufactured at a low cost and in as few production steps as possible.

DISCLOSURE OF THE INVENTION

The means of carrying out the invention of Claim 1 to solve the above-described problems exists in the configuration that the multi-partitioned body of a synthetic resin tubular container comprises:

at least a peelable portion extending over some peripheral length in a certain range of the ring cross-section and comprising an inner layer and an outer layer peelably laminated with the inner layer; and at least an adhered portion occupying the rest of the ring cross-section and comprising the inner layer and the outer layer unpeelably laminated with each other through the intermediary of an adhesive layer, wherein the peelable portion or portions and the adhered portion or portions form the ring cross-section, and wherein the inner layer breaks away from the outer layer of the peelable portion to form a partition wall or walls that consist of the inner layer and enable the inner space to be divided into compartments which can be filled with each of different contents separately.

In the invention of Claim 1, some length or lengths in the circumferential direction of the inner-/outer-layered ring cross-section are formed into a peelable portion or portions comprising the inner layer and the outer layer peelably laminated with this inner layer. Due to this configuration, the inner layer of the peelable portion can be broken away from the outer layer thereof when the multi-partitioned tubular containers are manufactured. As a result, the peeled inner layer or layers form a partition wall or walls to divide the inner space of the multi-partitioned tubular body into multiple compartments.

The inner space can be divided into compartments at a desired ratio of each compartment occupying in the cross-sectional area, by setting properly the peripheral range of each peelable portion and the shape of each peeled inner layer. It has thus become possible to manufacture easily the multi-partitioned tubular container having compartments to be filled separately with different contents at a certain fixed ratio. An example of such contents is an adhesive comprising a main agent and a curing agent, which are mixed at a certain ratio and discharged together when the adhesive is used.

In sealing the lower end of the multi-partitioned tubular body, the lower end can be pressed flat in a uniform thickness. This is because the peeled inner layer of this portion can be brought back to the original position so the tube would have a simple ring cross-section with no partition wall.

Before the inner layer is broken away from the outer layer, the multi-partitioned tubular body of this invention can be handled as a simple cylinder with no partition. Therefore, if the tube is decorated with a print or a hot stamp on the outer layer, existing decoration equipment can be used as it is. There is no particular factor that may raise the cost of decoration.

The partition wall for dividing the inner space is formed by breaking away from the outer layer a part of the inner layer that has been laminated with the outer layer. After the partition wall is formed, there is no change in the appearance of the outer layer. There occurs no inconvenience of producing any seam that impairs the appearance.

The means of carrying out the invention of Claim 2 includes the configuration of the invention of Claim 1, and additionally comprises that the inner layer and the outer layer are molded with synthetic resins that are highly compatible to the extent that the two layers are adhered with each other, that the peelable portion comprises the inner layer and outer layer laminated with each other through the intermediary of an adhesive layer that is laminated unpeelably to either one of the inner layer or the outer layer but is laminated peelably to the other one thereof, and that the adhered portion is formed by directly laminating the inner layer and the outer layer to each other.

In the invention of Claim 2, the inner layer, the outer layer, and the peelable layer are extruded together. Thereby a multi-partitioned tube having the peelable portion and the adhered portion is molded in an operation.

The means of carrying out the invention of Claim 3 includes the configuration of the invention of Claim 1, and additionally comprises that the inner layer and the outer layer are molded from synthetic resins that are compatible to the extent that the two layers are peeled from each other, that the peelable portion comprises the inner layer and the outer layer directly laminated with each other, and that the adhered portion has the inner layer and the outer layer laminated unpeelably with each other through the intermediary of an adhesive layer.

In the invention of Claim 3, the inner layer, the outer layer, and the adhesive layer are extruded together. Thereby a multi-partitioned tube having the peelable portion and the adhered portion is molded.

The invention of Claim 4 includes the configuration of the invention of Claim 1, 2, or 3, and additionally comprises that a half peripheral length on either right or left side of the ring cross-section is used as the peelable portion and that the inner layer breaks away from the outer layer of the peelable portion to form a partition wall that consists of the peeled inner layer and allows the inner space to be divided into two compartments.

In the invention of Claim 4, the peelable portion has a half peripheral length on either right or left side of the ring cross-section, and the partition wall is set at the same length as the half peripheral length of the multi-partitioned tube. When the lower end of the multi-partitioned tube is pressed flat from both the right and the left sides to deform the ring cross-section near the lower end into an elongated, much flattened shape, the partition wall flexibly follows the movement, and helps the lower end become flat. The partition wall also prevents the desired cross-sectional ratio of the inner space from being changed disadvantageously.

The means of carrying out the invention of Claim 5 includes the configuration of the invention of Claim 1, 2, or 3, and additionally comprises that the peelable portions are disposed on both sides of the ring cross-section over some peripheral lengths in certain ranges of the ring cross-section and that the inner layer breaks away from the outer layer of each peelable portion to form each of the two partition walls that consist of the inner layer and allow the inner space to be divided into three compartments.

In the invention of Claim 5, the peelable portions are disposed on both sides and in certain ranges of the ring cross-section, and thereby two partition walls are formed in positions facing each other. These partition walls divide the inner space of the multi-partitioned tube into three compartments. If the multi-partitioned body of a tubular container made of this multi-partitioned tube is squeezed from both sides, all the compartments are pressed uniformly, and the contents in the respective compartments can be simultaneously discharged.

PREFERRED EMBODIMENTS OF THE INVENTION

Figure 1:
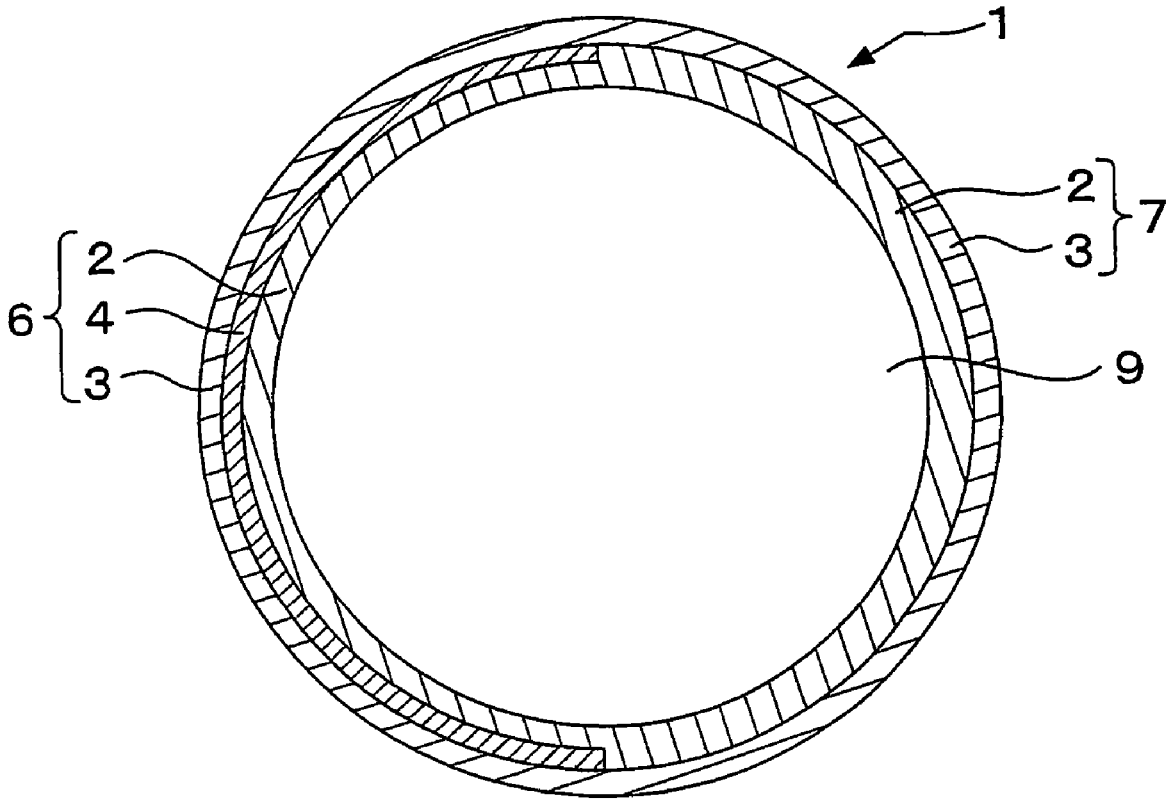
FIG. 1 is a cross-sectional view showing an example of the multi-partitioned body of a tubular container in the first embodiment of this invention in the state that inner space is not partitioned.

The multi-partitioned body of a tubular container 1 is further described with respect to the embodiments of this invention, now referring to the drawings.

FIG. 1(A) is a cross-sectional view showing an example of the multi-partitioned body of a tubular container in the first embodiment of this invention. The multi-partitioned body of a tubular container 1 has a ring cross-section, with the peelable portion 6 being formed along the left half periphery, and the adhered portion 7 along the right half periphery. The peelable portion 6 comprises an inner layer 2, a peelable layer 4 unpeelably laminated with the inner layer 2, and an outer layer 3 peelably laminated with the peelable layer 4. The adhered portion 7 comprises the inner layer 2 and the outer layer 3 unpeelably laminated with each other.

Figure 2:
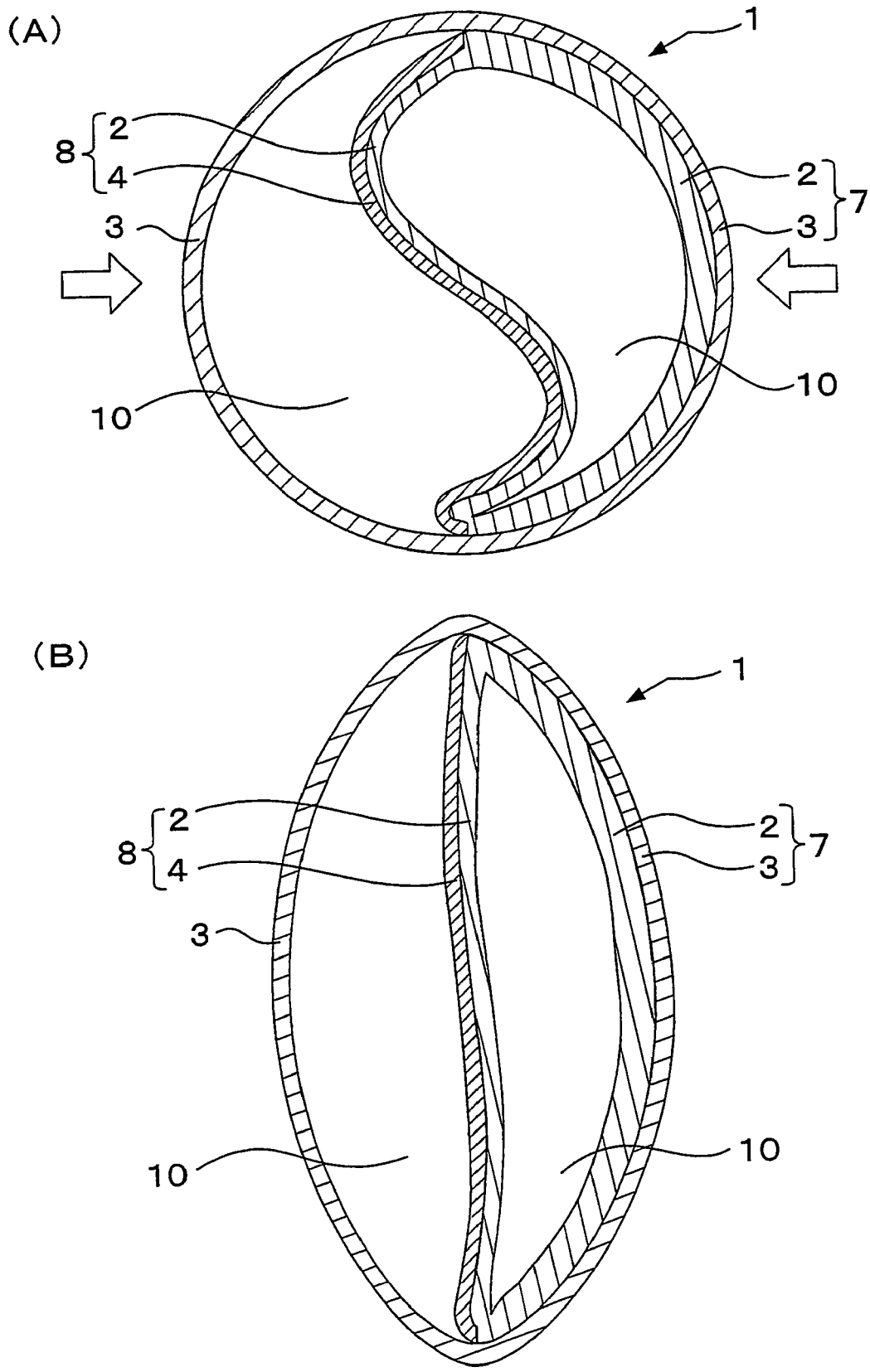
FIGS. 2(A) and 2(B) are cross-sectional views of the multi-partitioned body of a tubular container shown in FIG. 1, wherein 2(A) shows the state before squeezing; and 2(B), a much flattened state after pressing.
Figure 7:
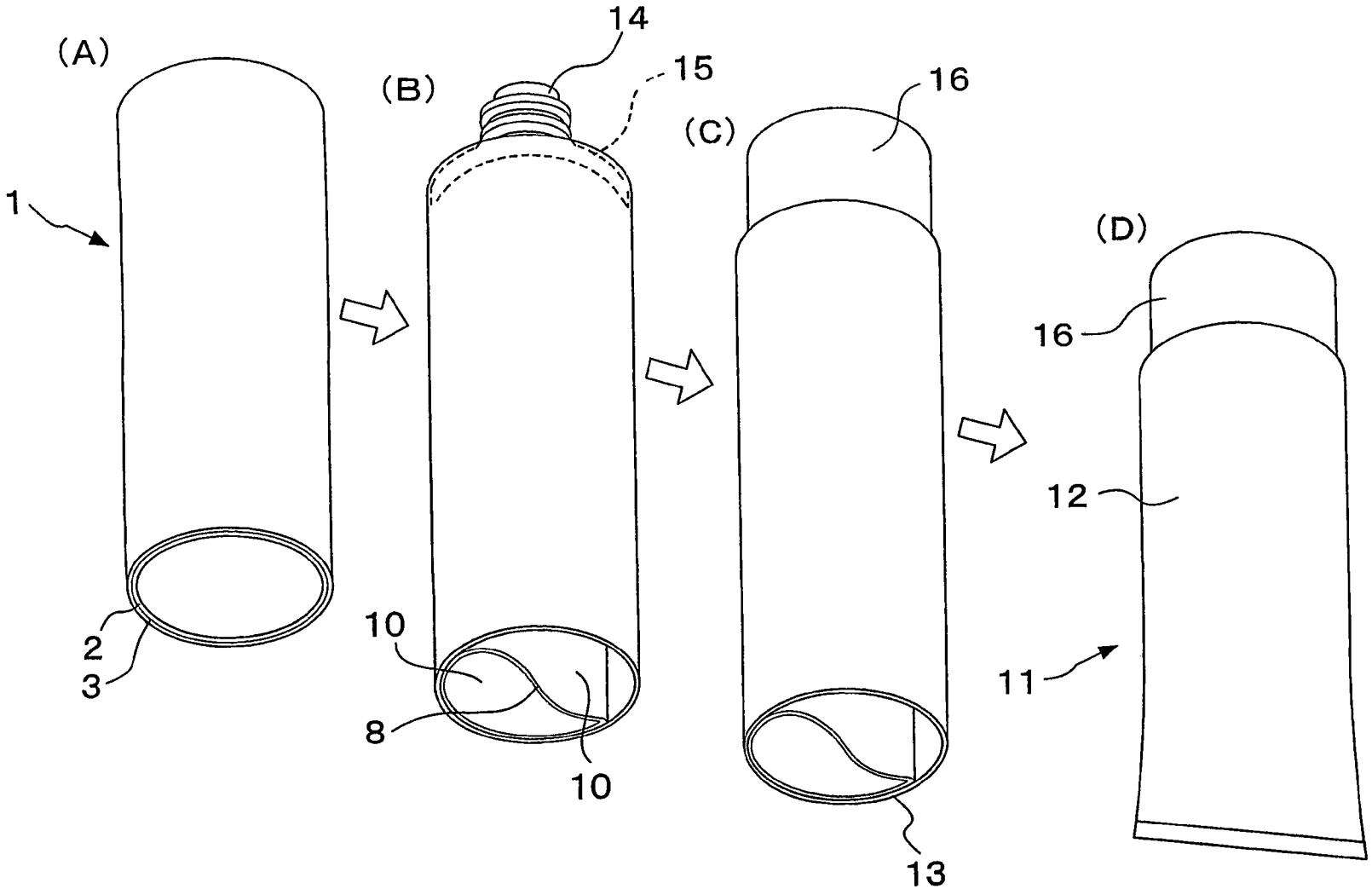
FIG. 7(A), 7(B), 7(C), and 7(D) are explanatory diagrams showing an example of the process for manufacturing the multi-partitioned body of a tubular container of this invention.

When the multi-partitioned tube 11 is manufactured from this multi-partitioned body of a tubular container 1, as shown in FIG. 7, the peelable layer 4 of the peelable portion 6 is broken away from the outer layer 3 toward the inside, as shown in FIG. 2(A). This peelable layer 4, along with the inner layer 2 laminated with the peelable layer 4, forms a partition wall 8 in a curved S-letter shape. This partition wall 8 divides the inner space 9 into two compartments—a compartment 10 on the left side and the other compartment 10 on the right side—at a given ratio occupying in the cross-sectional area.

The multi-partitioned body of a tubular container 1 is pressed flat at its lower end from both the right and left sides so as to form the sealed portion of the multi-partitioned tube 11. When the multi-partitioned body of a tubular container 1 shown in FIG. 2(A) is pressed from both sides, the ring cross-section at the lower end is deformed to an elongated, much flattened shape, as shown in FIG. 2(B). At that time, the partition wall 8 is not pulled laterally, but is deformed in a slightly curved shape along the long axis of the elliptical shape, thus allowing the ratio occupying in the cross-sectional area to be maintained between the right and left compartments 10.

Figure 3:
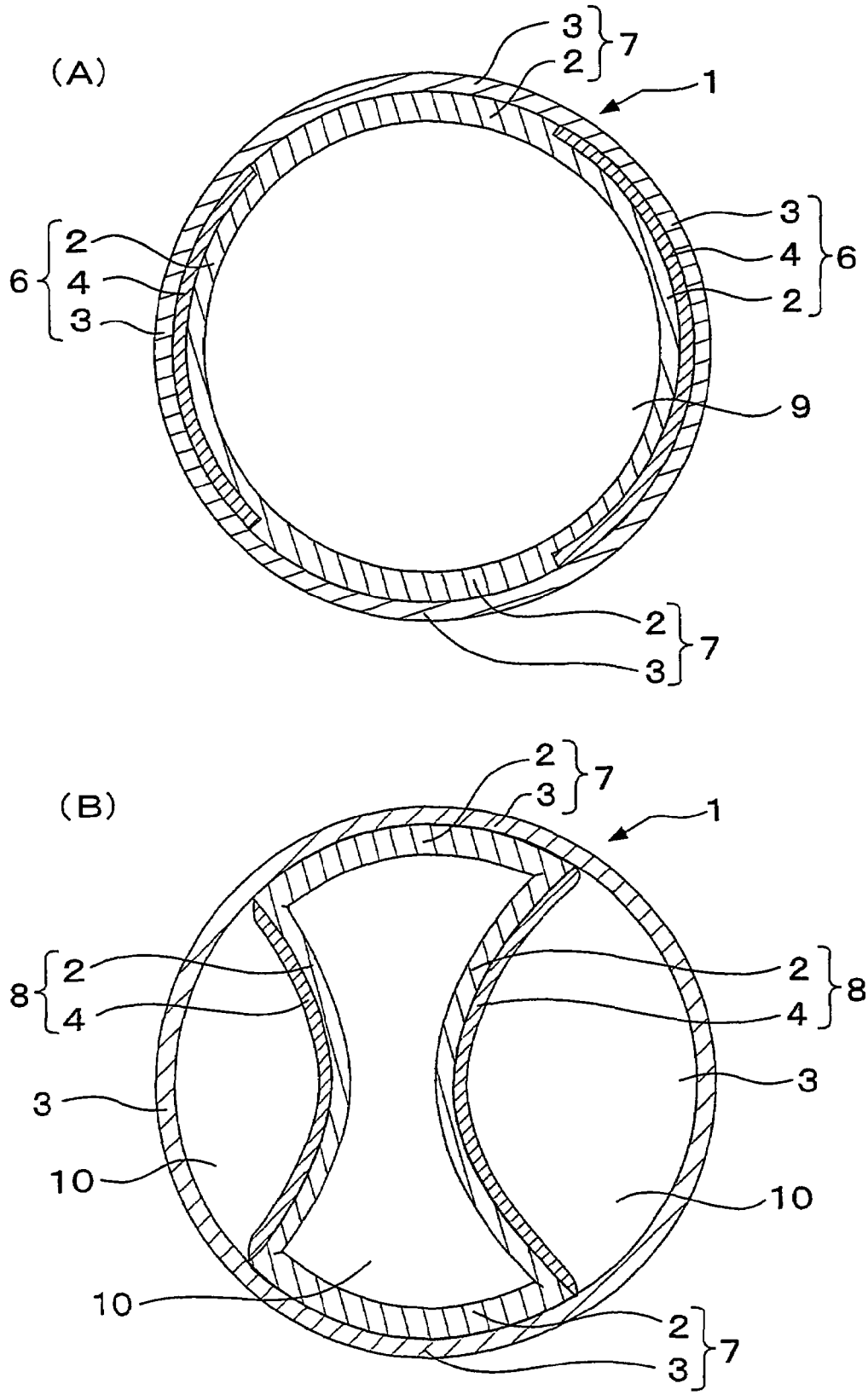
FIGS. 3(A) and 3(B) are cross-sectional views showing another example of the multi-partitioned body of a tubular container in the first embodiment of this invention, wherein 3(A) shows the state in which inner space is not partitioned; and 3(B), the state in which inner state has been partitioned.

FIG. 3(A) is a cross-sectional view showing another example of the multi-partitioned body of a tubular container 1 in the first embodiment of this invention having a ring cross-section. The multi-partitioned body of a tubular container 1 has a peelable portion 6, which is disposed on the left side of the ring cross-section over some peripheral length in a certain range of the ring cross-section and comprises the inner layer 2, the peelable layer 4 unpeelably laminated with the inner layer 2, and an outer layer 3 peelably laminated with the inner layer 2. The multi-partitioned body of a tubular container 1 also has the other peelable portion 6, which is disposed on the right side of the ring cross-section over some peripheral length in a certain range of the ring cross-section and comprises similarly the inner layer 2, the peelable layer 4 unpeelably laminated with the inner layer 2, and the outer layer 3 peelably laminated with the peelable layer 4. The rest of the ring cross-section is occupied by a pair of adhered portions 7, each comprising the inner layer 2 and the outer layer 3 unpeelably laminated with each other.

When the multi-partitioned tube 11 is manufactured from this multi-partitioned body of a tubular container 1, the peelable layers 4 break away respectively from the outer layer 3 of the peelable portions 6 to form two partition walls 8 consisting of the peelable layer 4 and the inner layer 2, as shown in FIG. 3(B). These partition walls 8 divide the inner space 9 into a compartment 10 located on the left side, a compartment 10 located in the center, and a compartment 10 located on the right side. The compartments can be filled with each of different contents separately.

FIG. 3(B) shows both peelable layers 4, which are reversed toward each other as these layers have broken away from the outer layer 3. In this state, the three compartments 10 are divided at a ratio of 1:2:2 occupying in the cross-sectional area. This ratio in the cross-sectional area is set in response to the proportions in which the respective contents are packed in the multi-partitioned tube 11.

The multi-partitioned body of a tubular container 1 in both examples of the above-described embodiments can be molded by well-known co-extrusion molding. Concerning the materials used in these layers, the inner layer 2 and the peelable layer 4, as well as the inner layer 2 and the outer layer 3, are required to be a combination of highly compatible resins to the extent that these pairs will be adhered to each other when the body of a tubular container is molded. In contrast, it is necessary that the peelable layer 4 and the outer layer 3 have low compatibility to each other to the extent that the two layers are peeled from each other so that these layers are not be adhered when the body of a tubular container is molded.

Furthermore, it is preferred that the inner layer 2 and the outer layer 3 used to form the body 12 of the multi-partitioned tube 11 are made of resins excelling in such properties as moldability, cost effectiveness, mechanical strength, flexibility, and chemical stability. The peelable layer 4 should be made of a non-penetrative resin that can prevent a component or components of the contents in the respective compartments 10 from moving into another or other compartments 10.

Examples of the materials that satisfy these conditions include adhesive polyolefin resins, such as ADMER (brand name) and MODIC (brand name) for the inner layer 2; olefin resins for the outer layer 3; and ethylene-vinyl alcohol copolymer (EVOH) and nylon resins for the peelable layer 4.

Figure 4:
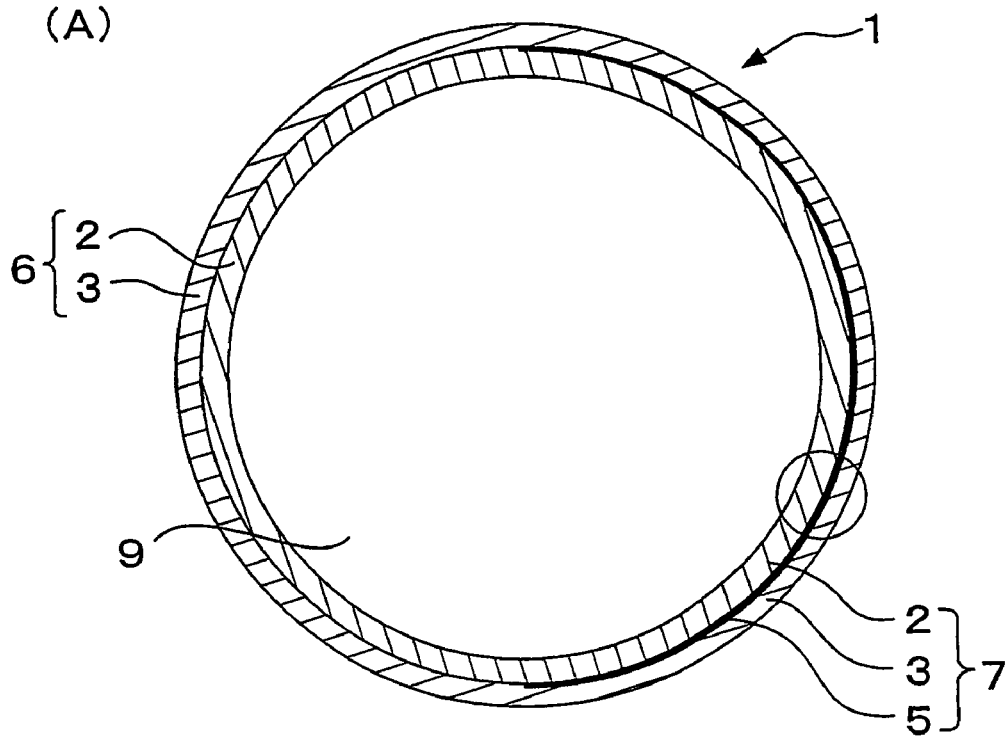
FIGS. 4(A) and 4(B) are cross-sectional views showing an example of the multi-partitioned body of a tubular container in the second embodiment of this invention, with 4(A) showing the state in which inner space is not partitioned; and 4(B), a partially enlarged view of the portion indicated by a circle in FIG. 4(A).
Figure 4:
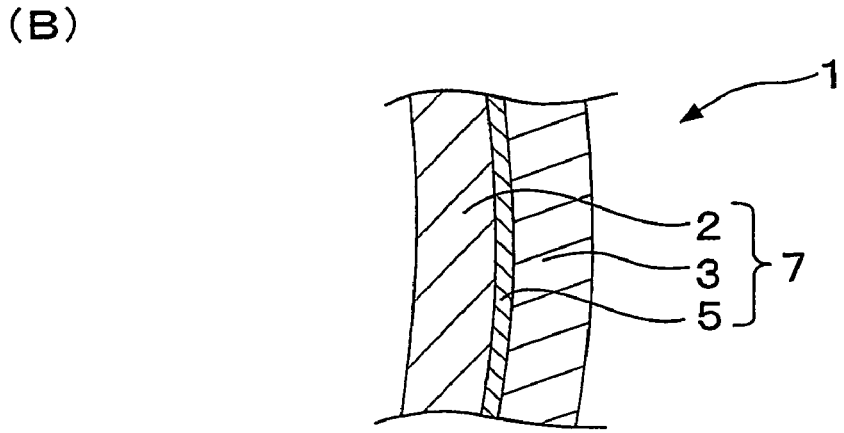

FIG. 4(A) is a cross-sectional view showing an example of the multi-partitioned body of a tubular container in the second embodiment of this invention. The multi-partitioned body of a tubular container 1 has a ring cross-section, with the peelable portion 6 being formed along the left half periphery, and the adhered portion 7 along the right half periphery. The peelable portion 6 comprises an inner layer 2 and an outer layer 3 peelably laminated with the inner layer 2. The adhered portion 7 comprises the inner layer 2 and the outer layer 3 unpeelably laminated with each other through the intermediary of an adhesive layer 5, as shown in the enlarged view of FIG. 4(B).

Figure 5:
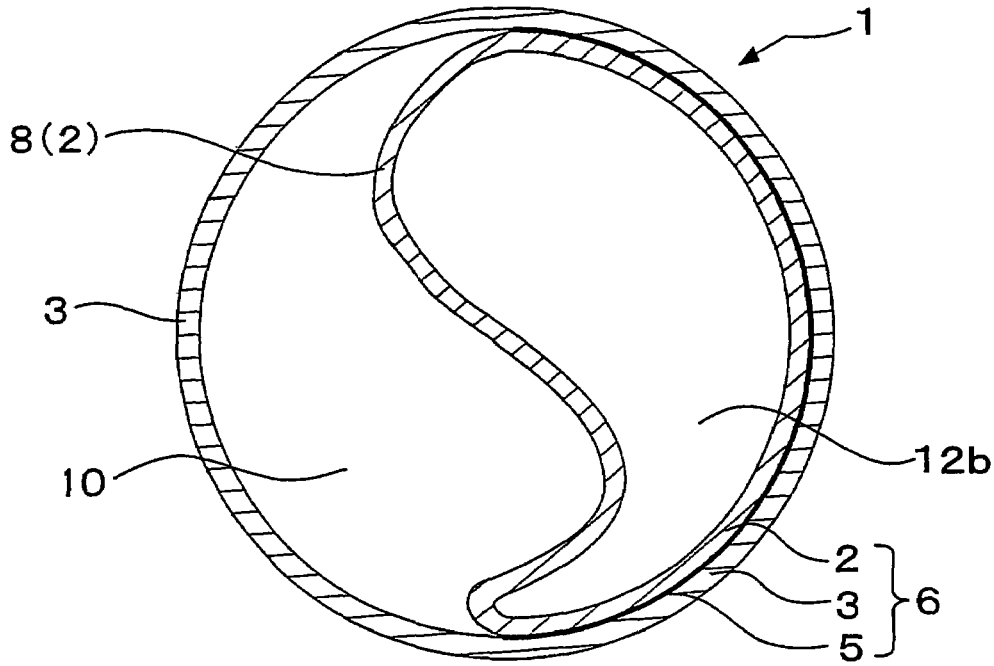
FIGS. 5(A) and 5(B) are cross-sectional views of the multi-partitioned body of a tubular container shown in FIGS. 4(A) and 4(B), wherein 5(A) shows the state in which inner space has been partitioned; and 5(B), a much flattened state after squeezing.
Figure 5:
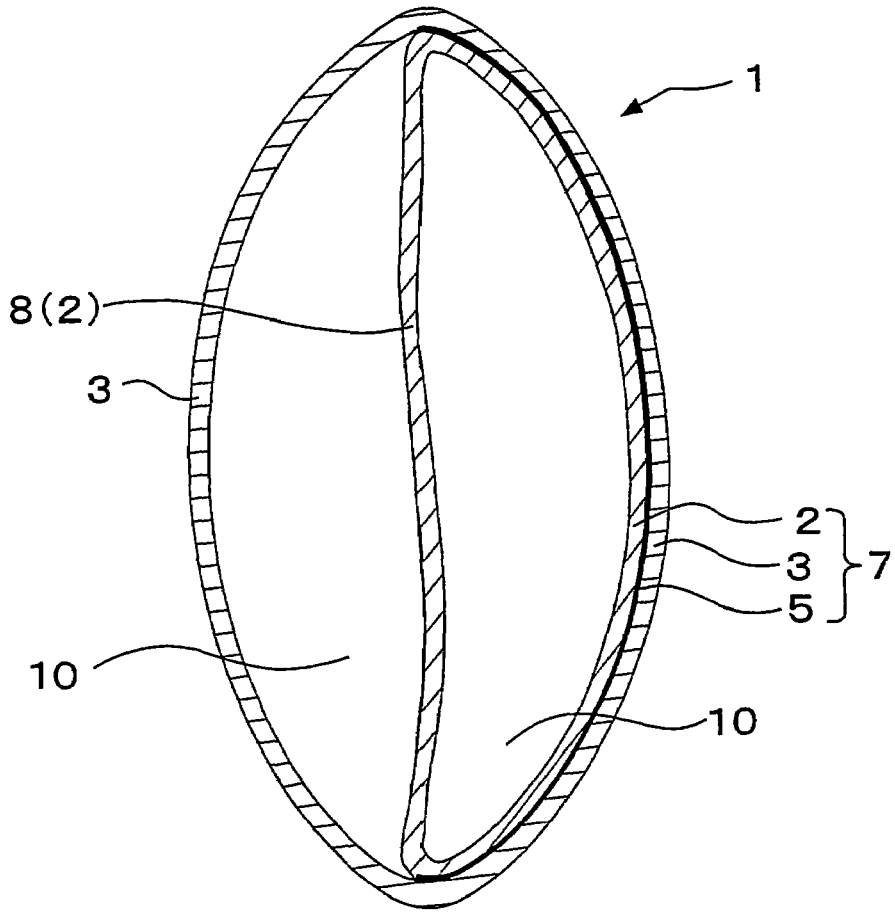

When the multi-partitioned tube 11 is manufactured from this multi-partitioned body of a tubular container 1, as shown in FIG. 7, the inner layer 2 of the peelable portion 6 is broken away from the outer layer 3 toward the inside, as shown in FIG. 5(A). The inner layer 2 forms a partition wall 8 in a curved S-letter shape. This partition wall 8 divides the inner space 9 into two compartments—a compartment 10 on the left side and the other compartment 10 on the right side—at a given ratio occupying in the cross-sectional area.

The multi-partitioned body of a tubular container 1 is pressed flat at its lower end from both the right and left sides so as to form the sealed portion of the multi-partitioned tube 11. When the multi-partitioned body of a tubular container 1 is pressed from both sides, the ring cross-section at the lower end is deformed to an elongated, much flattened shape, as shown in FIG. 5(B). At that time, the partition wall 8 is not pulled laterally, but is deformed in a slightly curved shape along the long axis of the elliptical cross-section, thus allowing the ratio occupying in the cross-sectional area to be maintained between the two compartments 10.

Figure 6:
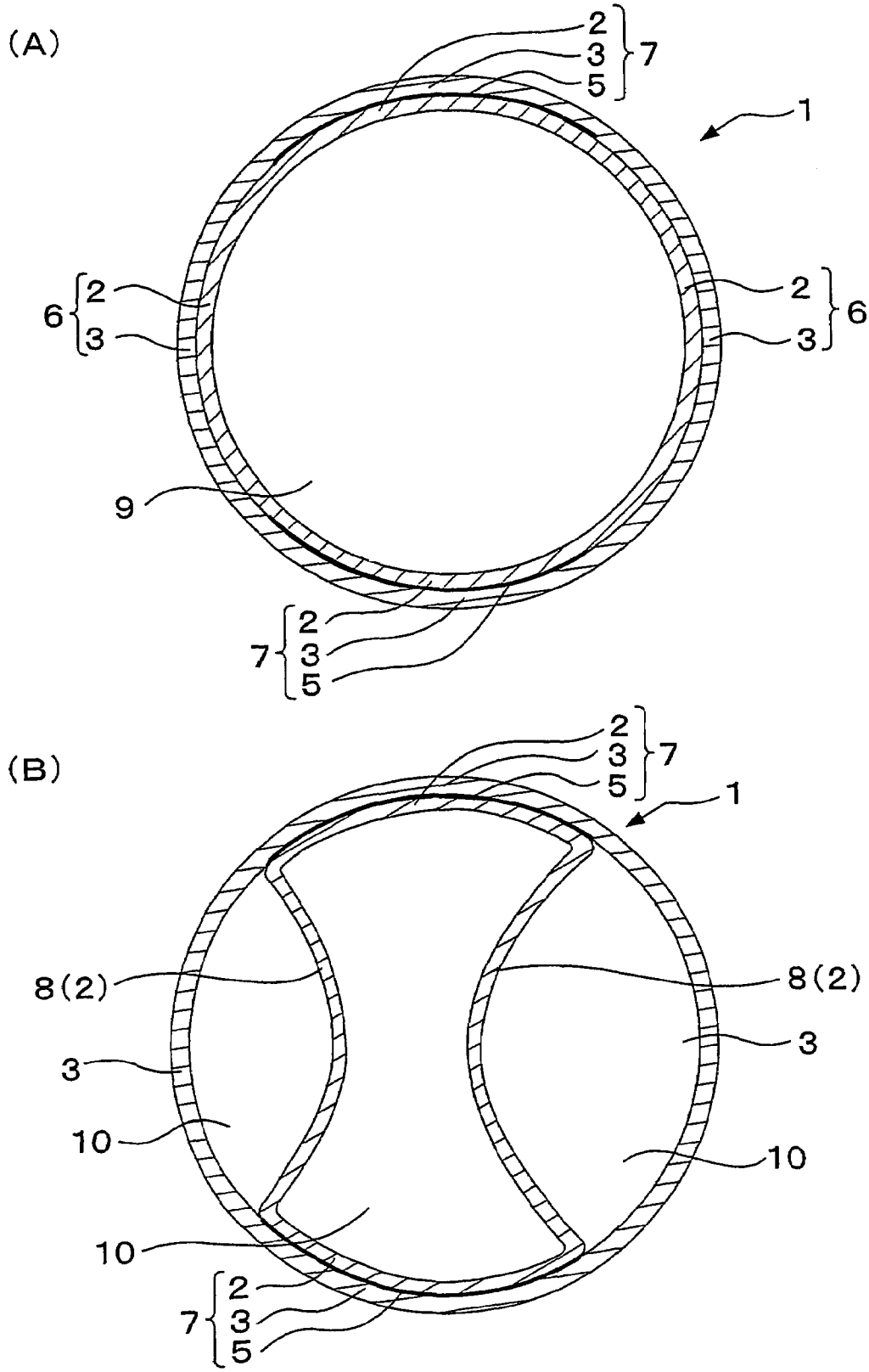
FIGS. 6(A) and 6(B) are cross-sectional views showing another example of the multi-partitioned body of a tubular container in the second embodiment of this invention, wherein 6(A) shows the state in which inner space is not partitioned; and 6(B), the state in which inner space has been partitioned.

FIG. 6(A) is a cross-sectional view showing another example of a multi-partitioned body of a tubular container 1 in the second embodiment of this invention having a ring cross-section. The multi-partitioned body of a tubular container 1 has a peelable portion 6, which is disposed on the left side of the ring cross-section over some peripheral length in a certain range of the ring cross-section and comprises the inner layer 2 and the outer layer 3 peelably laminated with the inner layer 2. The multi-partitioned body of a tubular container 1 also has the other peelable portion 6, which is disposed on the right side of the ring cross-section over some peripheral length in a certain range of the ring cross-section and comprises similarly the inner layer 2 and the outer layer 3 peelably laminated with the inner layer 2. The rest of the ring cross-section is occupied by a pair of adhered portions 7, which are disposed on the upper and lower portions of the ring cross-section and respectively comprise the inner layers 2 and the outer layer 3 unpeelably laminated with each other through the intermediary of the adhesive layers 5.

When the multi-partitioned tube 11 is manufactured from this multi-partitioned body of a tubular container 1, the inner layers 2 break away respectively from the outer layer 3 to form two partition walls 8 consisting of the inner layers 2, as shown in FIG. 6(B). These partition walls 8 divide the inner space 9 into a compartment 10 located on the left side, a compartment 10 located in the center, and a compartment 10 located on the right side.

FIG. 6(B) shows the inner layers 2, which are reversed toward each other as these layers have broken away from the outer layer. In this state, the respective compartments 10 are divided at a ratio of 1:2:2 occupying in the cross-sectional area. This ratio in the cross-sectional area is set in response to the proportions in which the respective contents are packed in the multi-partitioned tube 11.

The multi-partitioned body of a tubular container 1 in the above-described embodiments can be molded by well-known co-extrusion molding. As examples of the materials used in these layers, the material for the inner layer 2 may include a nylon resin; for the outer layer 3, a polyolefin resin that is less compatible with the nylon resin; and for the adhesive layer 5, an adhesive resin having full adhesion to the nylon resin and the polyolefin resin.

An example of a process for manufacturing the multi-partitioned tube 11 from the above-described multi-partitioned body of a tubular container 1 is described, referring to FIG. 7. The multi-partitioned body of a tubular container 1 is extruded from the die head by the extruder, and is cut to a given length adequate for the body 12 of the multi-partitioned tube 11, as shown in FIG. 7(A).

The multi-partitioned body of a tubular container 1 is decorated on the surface by the printing or the hot stamping, while preventing deformation by inserting a shape-retaining jig inside the body 1.

After the decorating operation, the shape-retaining jig is pulled out, and the inner space 9 of the multi-partitioned body of a tubular container 1 is divided into compartments 10 of certain cross-sectional shapes by making the inner layer 2 break away from the outer layer 3. Then, the head portion 15, which has been integrated with neck 14 to discharge the contents, is welded onto the upper end of the multi-partitioned body of a tubular container 1 by means of injection molding, etc., as shown in FIG. 7(B).

Cap 16 is screwed on the neck 14 to close the mouth, as shown in FIG. 7(C). Then, the multi-partitioned body of a tubular container 1 is placed upside down to bring the lower end 13 to the topside. Predetermined amounts of different contents are filled in the compartments 10 through the lower end 13 that has now been turned upside.

Finally, the lower end 13 is pressed flat from both sides and sealed. The multi-partitioned tube 11 is now completed, as shown in FIG. 7(D).

INDUSTRIAL APPLICABILITY

This invention having the above-described configuration has the following effects:

In the invention of Claim 1, some peripheral length or lengths in a certain range or ranges of the ring cross-section are formed into a peelable portion or portions. When the inner layer or layers of a peelable portion or portions can be broken away from the outer layer thereof, the peeled inner layer or layers form a partition wall or walls to divide the inner space into multiple compartments which can be filled with each of different contents separately.

The inner space can be divided into compartments at a desired ratio of cross-sectional area for each compartment, by setting properly the peripheral range of each peelable portion and the shape of each peeled inner layer. It has thus become possible to manufacture easily the multi-partitioned tubular container having compartments to be filled separately with different contents at a certain fixed ratio.

The multi-partitioned body of a tubular container returns to the previous ring cross-section by bringing the peeled inner layer back to the original position at the lower end of the body. In that state, the lower end of the body can be pressed flat in a uniform thickness and sealed stably, smoothly, and securely.

In the invention of Claims 2 and 3, the multi-partitioned body of a tubular container has a simple cross-sectional structure in which a peelable layer or layers or an adhesive layer or layers are laminated between the inner layer and the outer layer. Due to this simple structure, the multi-partitioned body of a tubular container can be molded in one operation of co-extrusion molding, without creating any seam that impairs the outer appearance. The cost of production can also be reduced.

In the invention of Claim 4, the ratio of both compartments occupying in the cross-sectional area can be maintained at a constant level. Thus, it becomes possible to manufacture easily the multi-partitioned tubular container from which two different types of contents are discharged always at a certain ratio.

In the invention of Claim 5, it is possible to obtain a multi-partitioned body of a tubular container, in which two partition walls facing each other give three compartments that are disposed laterally in a row. Therefore, it becomes possible to manufacture easily the multi-partitioned tubular container from which different contents inside the respective compartments can be simultaneously discharged by squeezing the tubular body from both sides.

The invention claimed is:

1. A multi-partitioned body of a synthetic resin tubular container having the cross-section of a ring and comprising:

at least a peelable portion extending over some peripheral length in a certain range of the ring cross-section and comprising an inner layer and an outer layer peelably laminated with each other; and at least an adhered portion occupying the rest of the ring cross-section and comprising said inner layer and said outer layer unpeelably laminated with each other, wherein said inner layer breaks away from the outer layer of said peelable portion to form a partition wall or walls that enable an inner space of the tubular container to be divided into compartments which can be filled with each of different contents separately, and wherein the divided compartments each are in communication with a common opening, such that the contents in the respective compartments can be simultaneously discharged through the common opening.

2. The multi-partitioned body of a synthetic resin tubular container, according to claim 1, wherein the inner layer and the outer layer are molded from synthetic resins that are highly compatible to the extent that the two layers are adhered with each other, wherein the peelable portion comprises the inner layer and outer layer laminated with each other through the intermediary of an adhesive layer that is laminated undetachably to either one of the inner layer or the outer layer but is laminated detachably to the other one thereof, and wherein the adhered portion is formed by directly laminating the inner layer and the outer layer to each other.

3. The multi-partitioned body of a synthetic resin tubular container, according to claim 2, wherein a half peripheral length on either right or left side of the ring cross-section is used as the peelable portion and wherein the inner layer breaks away from the outer layer of said peelable portion to form a partition wall that consists of said peeled inner layer and allows the inner space to be divided into two compartments.

4. The multi-partitioned body of a synthetic resin tubular container, according to claim 2, wherein the peelable portions are disposed on both sides of the ring cross-section over some peripheral lengths in certain ranges of the ring cross-section and wherein the inner layer breaks away from the outer layer of each peelable portion to form two partition walls that consist of said inner layer and allow the inner space to be divided into three compartments.

5. The multi-partitioned body of a synthetic resin tubular container, according to claim 1, wherein the inner layer and the outer layer are molded from synthetic resins that are compatible to the extent that the two layers are peeled from each other, wherein the peelable portion comprises said inner layer and said outer layer directly laminated with each other, and wherein the adhered portion has said inner layer and said outer layer laminated undetachably with each other through the intermediary of an adhesive layer.

6. The multi-partitioned body of a synthetic resin tubular container, according to claim 5, wherein a half peripheral length on either right or left side of the ring cross-section is used as the peelable portion and wherein the inner layer breaks away from the outer layer of said peelable portion to form a partition wall that consists of said peeled inner layer and allows the inner space to be divided into two compartments.

7. The multi-partitioned tubesbody of a synthetic resin tubular container, according to claim 5, wherein the peelable portions are disposed on both sides of the ring cross-section over some peripheral lengths in certain ranges of the ring cross-section and wherein the inner layer breaks away from the outer layer of each peelable portion to form two partition walls that consist of said inner layer and allow the inner space to be divided into three compartments.

8. The multi-partitioned body of a synthetic resin tubular container, according to claim 1 wherein a half peripheral length on either right or left side of the ring cross-section is used as the peelable portion and wherein the inner layer breaks away from the outer layer of said peelable portion to form a partition wall that consists of said peeled inner layer and allows the inner space to be divided into two compartments.

9. The multi-partitioned body of a synthetic resin tubular container, according to claim 1, wherein the peelable portions are disposed on both sides of the ring cross-section over some peripheral lengths in certain ranges of the ring cross-section and wherein the inner layer breaks away from the outer layer of each peelable portion to form two partition walls that consist of said inner layer and allow the inner space to be divided into three compartments.

* * * * *

UNITED STATES PATENT AND TRADEMARK OFFICE

CERTIFICATE OF CORRECTION

PATENT NO. : 7,337,925 B2
APPLICATION NO. : 10/507499
DATED : March 4, 2008
INVENTOR(S) : Yasuyuki Imaizumi and Shigeo Iizuka It is certified that error appears in the above-identified patent and that said Letters Patent is hereby corrected as shown below:

In the Drawings:

Please correct Fig. 5A as follows:

Element 12b should be labeled as element 10

Col. 10, Please correct Claim 7 as follows:

"The multi-partitioned tubesbody" should read "The multi-partitioned body"

Signed and Sealed this

Sixteenth Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,337,925 B2
APPLICATION NO. : 10/507499
DATED : March 4, 2008
INVENTOR(S) : Yasuyuki Imaizumi and Shigeo Iizuka It is certified that error appears in the above-identified patent and that said Letters Patent is hereby corrected as shown below:

In the Drawings:

Please correct Fig. 5A as follows:

Element 12b should be labeled as element 10

Col. 10, Please correct Claim 7 line 1, as follows:

"The multi-partitioned tubesbody" should read "The multi-partitioned body"

This certificate supersedes the Certificate of Correction issued December 16, 2008.

Signed and Sealed this

Sixth Day of January, 2009

JON W. DUDAS
*Director of the United States Patent and Trademark Office*